US009583887B2

(12) United States Patent
Xing et al.

(10) Patent No.: US 9,583,887 B2
(45) Date of Patent: Feb. 28, 2017

(54) CABLE CONNECTOR ASSEMBLY WITH SPACER

(71) Applicant: FOXCONN INTERCONNECT TECHNOLOGY LIMITED, Grand Cayman, KY (US)

(72) Inventors: Da-Wei Xing, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/147,891

(22) Filed: May 5, 2016

(65) Prior Publication Data

US 2016/0329660 A1 Nov. 10, 2016

(30) Foreign Application Priority Data

May 5, 2015 (CN) ..... 2015 2 0281875

(51) Int. Cl.

| | |
|---|---|
| ***H01R 12/24*** | (2006.01) |
| ***H01R 13/6585*** | (2011.01) |
| ***H01R 13/642*** | (2006.01) |
| ***H01R 43/20*** | (2006.01) |
| *H01R 12/59* | (2011.01) |
| *H01R 9/24* | (2006.01) |
| *H01R 12/77* | (2011.01) |

(52) U.S. Cl.

CPC ..... *H01R 13/6585* (2013.01); *H01R 13/642* (2013.01); *H01R 43/20* (2013.01); *H01R 9/2416* (2013.01); *H01R 12/596* (2013.01); *H01R 12/775* (2013.01)

(58) Field of Classification Search

CPC ... H01R 12/596; H01R 12/775; H01R 9/2416
USPC ..... 439/497
See application file for complete search history.

(56) References Cited

U.S. PATENT DOCUMENTS

| | | | | |
|---|---|---|---|---|
| 6,726,503 | B2 * | 4/2004 | Waddell | H01R 24/60 439/465 |
| 7,435,132 | B1 * | 10/2008 | Fong | H01R 9/038 439/497 |
| 7,758,374 | B2 | 7/2010 | Yu et al. | |
| 8,303,329 | B2 | 11/2012 | Wu | |
| 8,721,361 | B2 | 5/2014 | Wu | |

(Continued)

*Primary Examiner* — Tho D Ta

(74) *Attorney, Agent, or Firm* — Wei Te Chung; Ming Chieh Chang

(57) ABSTRACT

A cable connector assembly has a connector and a cable with a number of coaxial wires and a number of unshielded wires. The connector includes an insulative housing with a front tongue and a rear end, a number of contacts with mating portions exposed on the front tongue and connecting portions exposed on the rear end, and a spacer assembled to the rear end. The spacer forms a plurality of positioning holes extending therethrough along a front-to-back direction, and a passageway extending therethrough along a vertical direction perpendicular to the front-to-back direction. The coaxial wires are inserted through the corresponding positioning holes and across the passageway to reach the corresponding contacts along the front-to-back direction so as to cut the coaxial wires in the passageway along the vertical direction.

17 Claims, 6 Drawing Sheets

(56) References Cited

U.S. PATENT DOCUMENTS

| | | | | |
|---|---|---|---|---|
| 8,764,488 | B2 * | 7/2014 | Zeng | H01R 13/6585 439/108 |
| 9,231,393 | B2 * | 1/2016 | Buck | H02G 7/00 |
| 2011/0306244 | A1 | 12/2011 | Zhang et al. | |
| 2013/0040492 | A1 * | 2/2013 | Wu | H01R 13/5808 439/607.55 |
| 2015/0044886 | A1 | 2/2015 | Little et al. | |

* cited by examiner

CABLE CONNECTOR ASSEMBLY WITH SPACER

BACKGROUND OF THE INVENTION

1. Field of the Invention

The present invention relates to a cable connector assembly, and more particularly to a cable connector assembly having a spacer to sort out and regulate the wires of a cable.

2. Description of Related Arts

U.S. Pat. No. 8,303,329 discloses a cable connector assembly having a connector and a cable. The connector includes an insulative housing, a plurality of contacts assembled to the insulative housing, and a metallic shell enclosing the insulative housing and the contacts. The cable includes a plurality of conductive wires mechanically and electrically connected to tail sections of the contacts by way of insulation displacement contact.

U.S. Pat. No. 8,721,361 discloses a cable connector assembly including a plurality of conductive wires mechanically and electrically connected to tail sections of corresponding contacts via a soldering process. Since the wires are not retained to any spacer, it is difficult to solder the wires.

U.S. Patent Application Publication No. 2015/0044886 discloses a cable connector assembly having a connector, a cable, and a spacer. The spacer has a plurality of positioning holes extending therethrough along a front-to-back direction to receive corresponding wires of the cable.

SUMMARY OF THE INVENTION

Accordingly, an object of the present invention is to provide a cable connector assembly having a cable with a plurality of coaxial wires and a plurality of unshielded wires. The cable connector assembly includes an insulative housing with a front tongue and a rear end, a plurality of contacts with mating portions exposed on the front tongue and connecting portions exposed on the rear end, and a spacer assembled to the rear end. The spacer forms a plurality of positioning holes extending therethrough along a front-to-back direction, and a passageway extending therethrough along a vertical direction perpendicular to the front-to-back direction. The coaxial wires are inserted through the corresponding positioning holes and across the passageway to reach the corresponding contacts along the front-to-back direction so as to cut the coaxial wires in the passageway along the vertical direction. Notably, the coaxial wires are retained to the spacer and across the passageway for an easy soldering process and an easy cut process.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to some preferred embodiments of the present invention.

Figure 1:
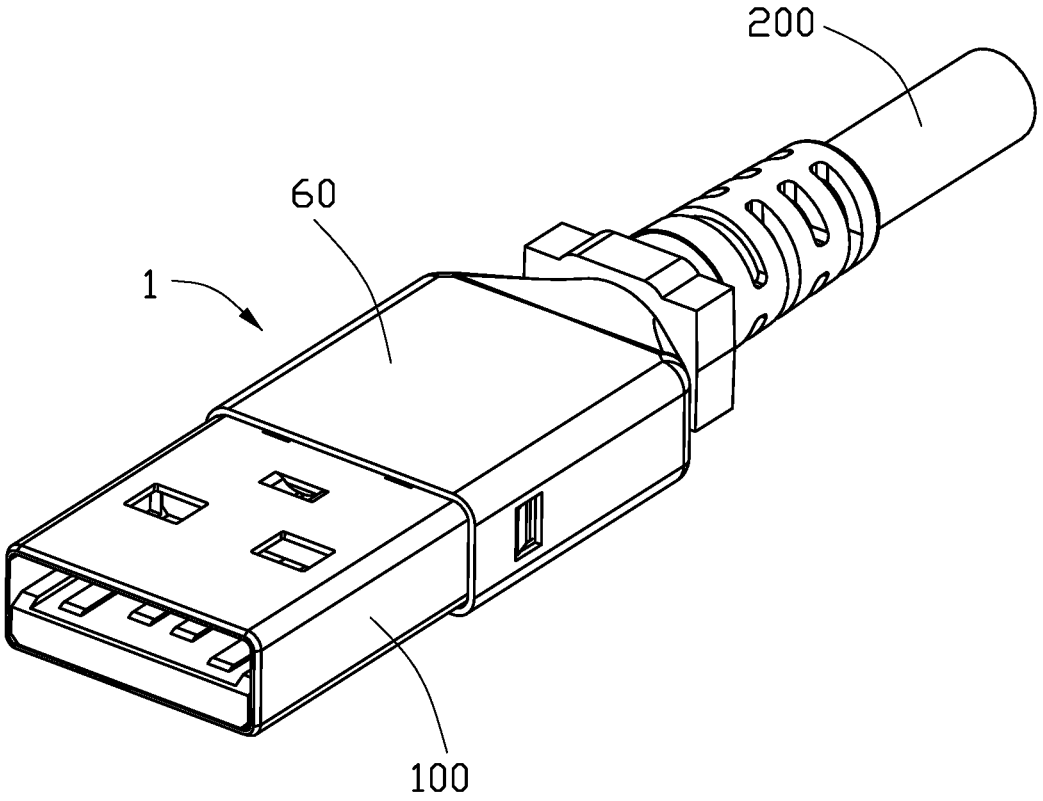
FIG. 1 is a front downward perspective view of a cable connector assembly in accordance with the present invention.
Figure 2:
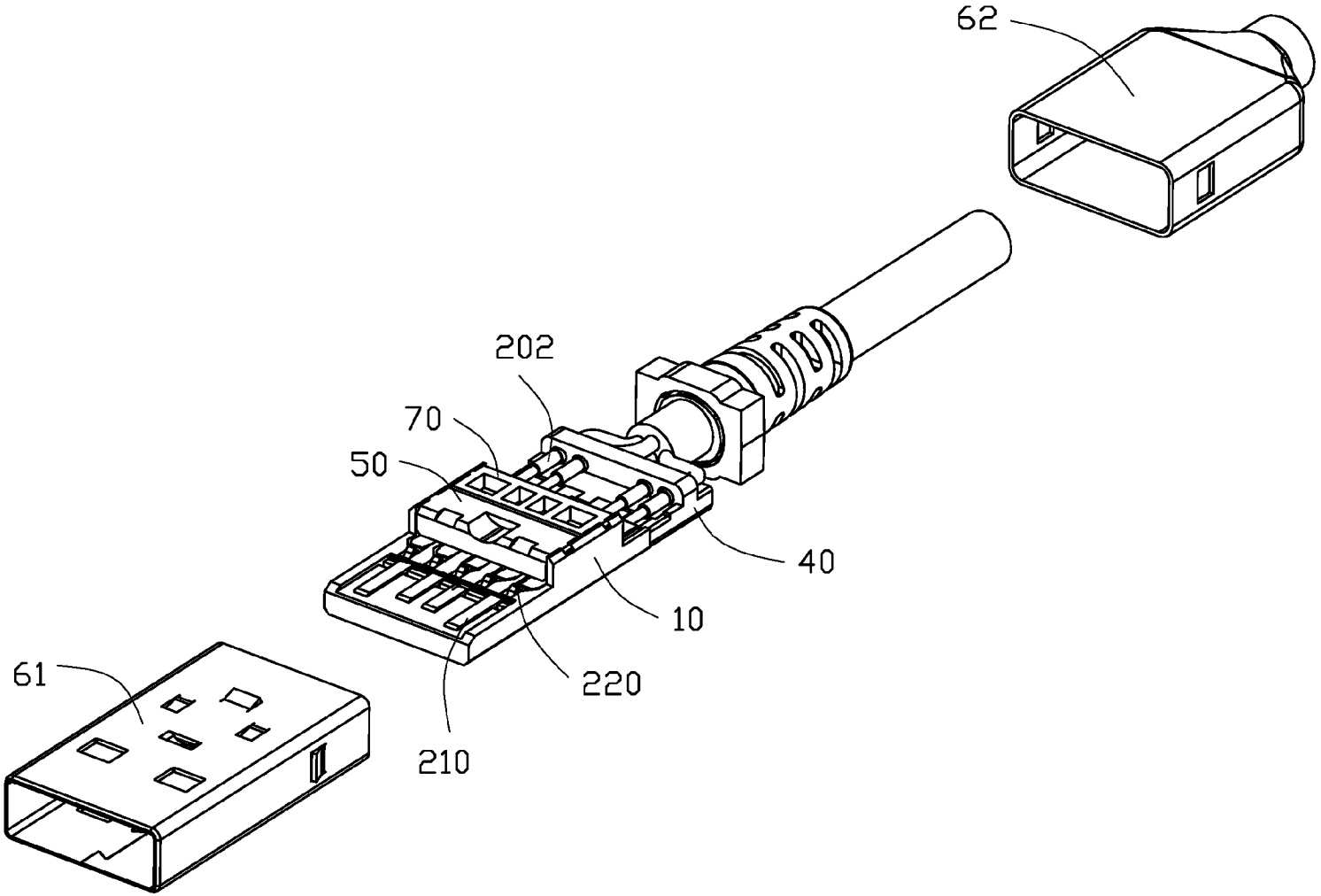
FIG. 2 is a front downward exploded view of the cable connector assembly of FIG. 1.
Figure 3:
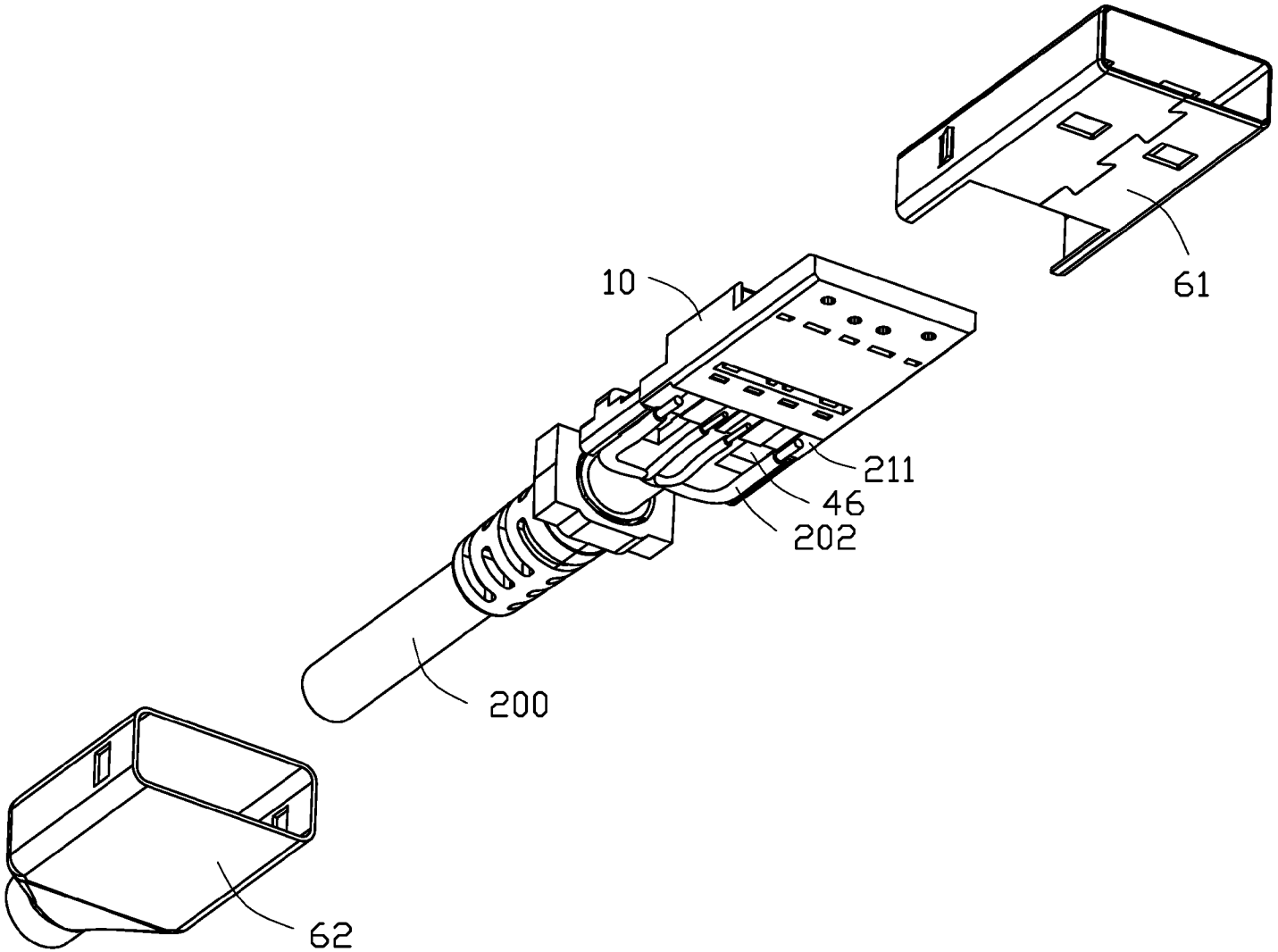
FIG. 3 is a front upward exploded view of the cable connector assembly of FIG. 1.
Figure 4:
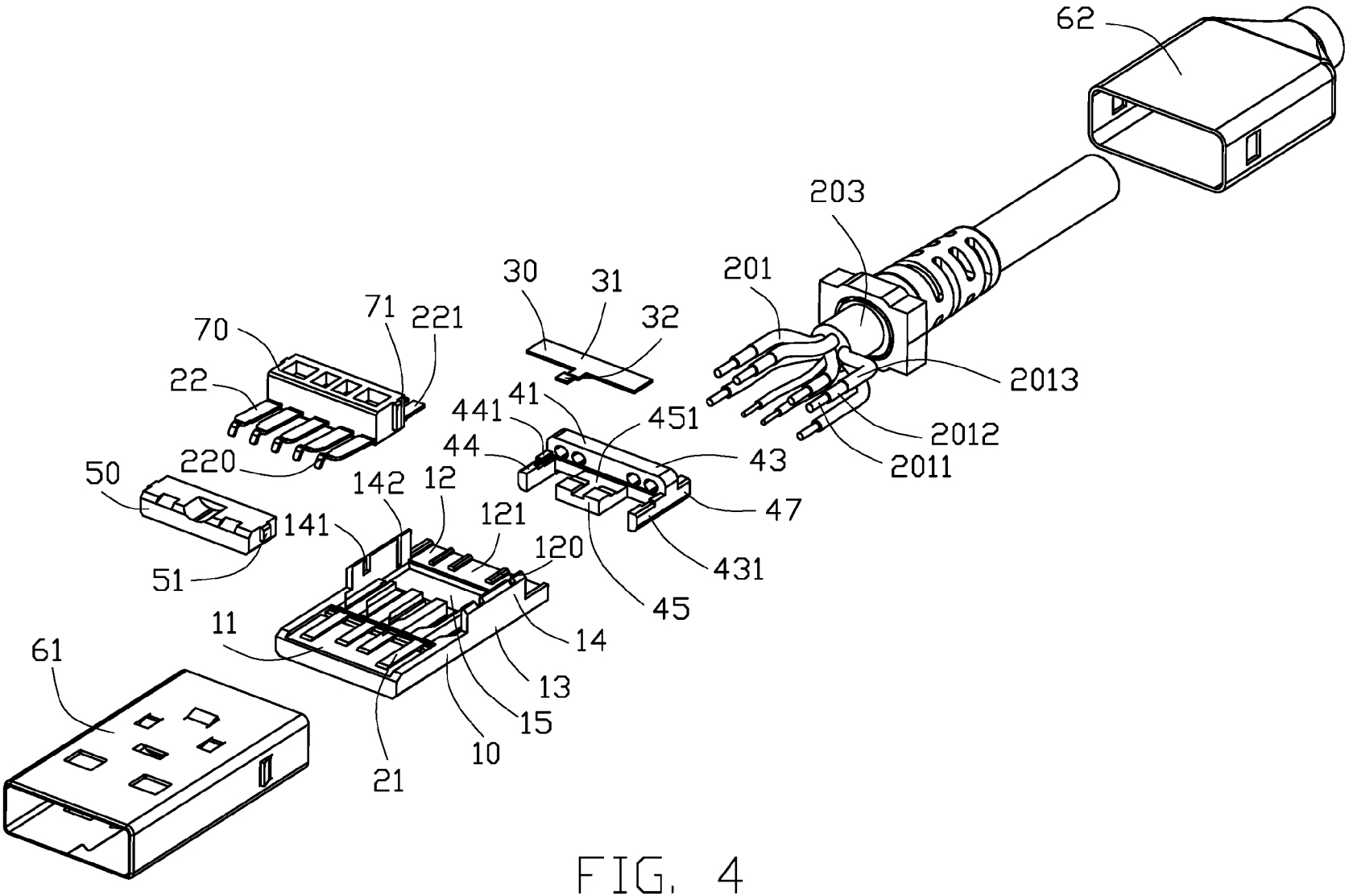
FIG. 4 is a further exploded view of the cable connector assembly of FIG. 2.
Figure 5:
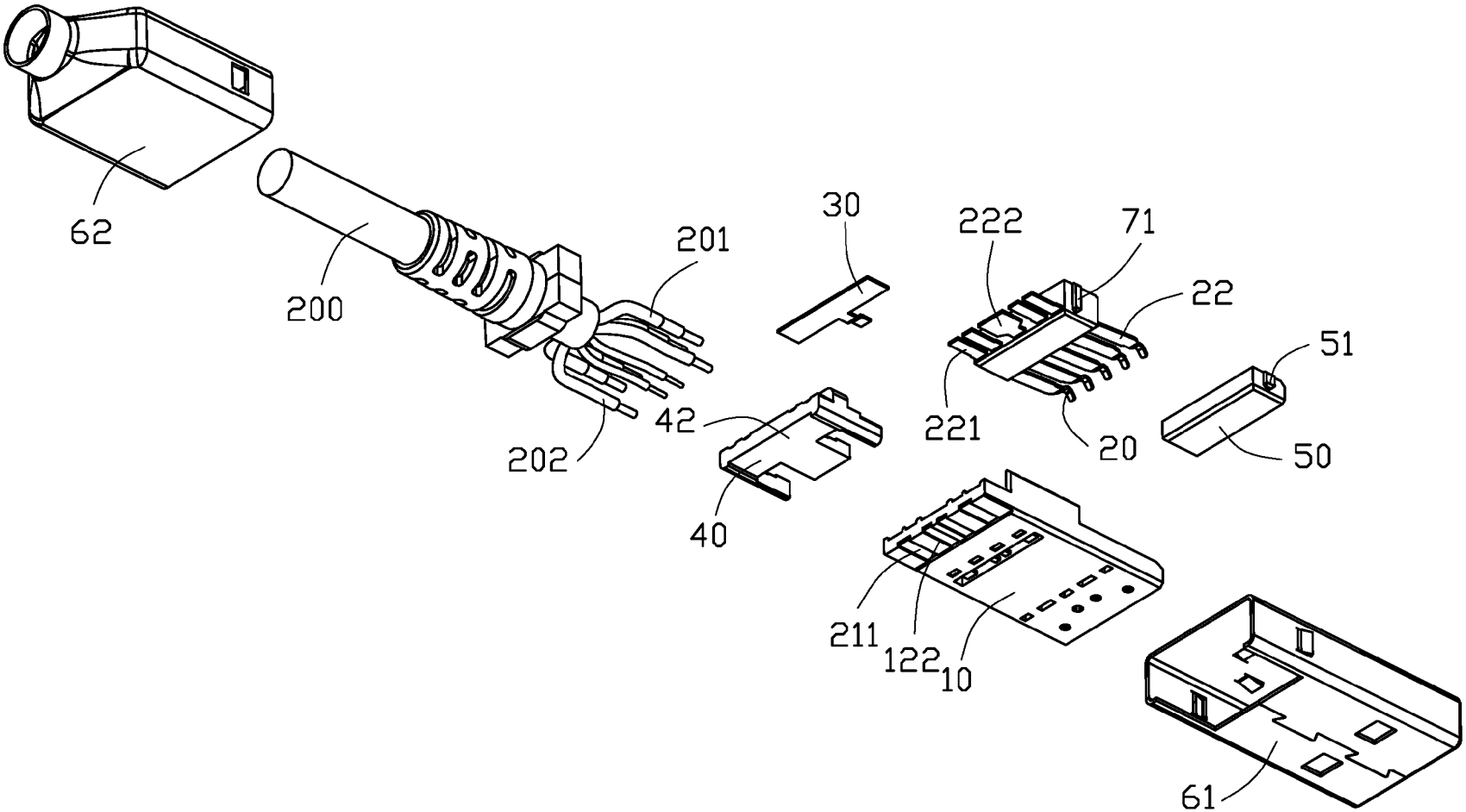
FIG. 5 is a further exploded view of the cable connector assembly of FIG. 3.
Figure 6:
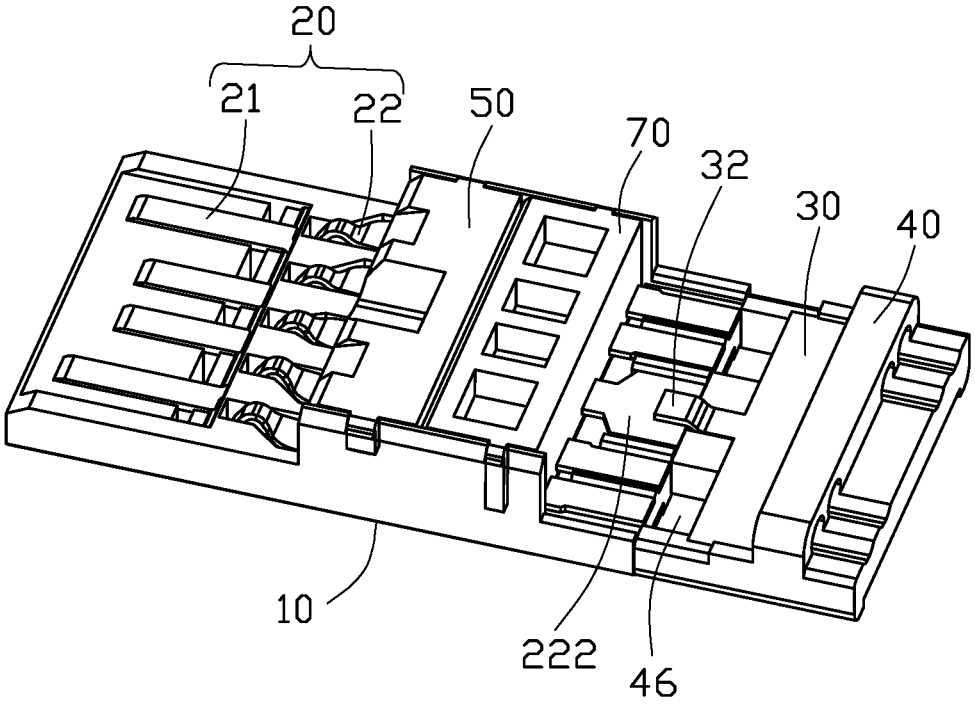
FIG. 6 is a rear downward view of the cable connector assembly of FIG. 1 with the metallic shell and the cable moved therefrom.

FIGS. 1 to 6 show a cable connector assembly 1 including a connector 100 and a cable 200. The connector 100 including an insulative housing 10 with a front section 11, a rear section 12, and a middle section 13 located therebetween. The front section 11 is a mating tongue with a mating surface thereon. A plurality of partitions 120 protrude upwardly from a top surface of the rear section 12. Each pair of neighbored partitions 120 defines an upward groove 121 therebetween. A pair of side projections 14 are formed on two opposite sides of the middle portion 13 and extend upwardly beyond the partitions 120 and the front section 11. A mounting cavity 15 is defined by the side projections 14. Each of the side projections 14 defines a first assembling groove 141 and a second assembling groove 142 extending in a vertical direction, wherein the second assembling groove 142 is disposed behind the first assembling groove 141.

A plurality of contacts 20 include a row of first contacts 21 retained to the insulative housing 10 and a row of second contacts 22 retained to an insulator 70. The second contacts 22 are retained in the insulator 70 by an assemble process or an insert molding process. The insulator 70 has a pair of first pegs 71 formed on the side walls thereof to comply with the corresponding first assembling grooves 141. The insulator 70 is received within the mounting cavity 15 of the insulative housing 10, wherein the top surface of the insulator 70 is aligned to the top surfaces of the side projections 14.

Each first contact 21 has a first mating/contacting portion 210 and a first connecting/tail portion 211 arranged along a front-to-back direction. Each second contact 22 has a second mating/contacting portion 220 and a second connecting/tail portion 221 arranged along the front-to-back direction. The first mating portions 210, the second mating portions 220, and the second connecting portions 222 are disposed on the top surface of the insulative housing 10. The first connecting portions 211 are disposed on the lower surface of the insulative housing 10. The first mating portion 210 has a planar plate contour embedded in the front section 11 and exposed upwardly to exterior. The second mating portion 220 has a curved resilient structure. The row of the first contacts 21 include four conductive contacts to transmit USB 2.0 signals. The row of second contacts 22 include five contacts to transmit USB 3.1 signals, wherein two pairs of the second contacts 22 are used to transmit high speed signals and one ground contact 222 is arranged therebetween. Each pair of the second contacts 22 is a differential signal pair, and the two differential signal pairs are used to transmit 10 Gbps signals.

An insulative block 50 is assembled to the mounting cavity 15 to downwardly abut against the second contacts 22 to prevent the front portions of the second contacts upward turning. A pair of second pegs 51 are formed on two opposite sides of the insulative block 50 to be inserted into the first mounting groove 141 and interference fit with the corresponding side projections 14. The top surface of the insulative block 50 is coplanar with the top surface of the insulator 70.

A spacer 40 is assembled to the rear section 12 of the insulative housing 10. The spacer 40 includes a base 47, a carrier 43 extending upwardly from a front distal of the base 47, a pair of bars 44 extending forwardly from two lateral sides of the base 47, and a platform 45 extending forwardly from a front middle portion of the base 47. A plurality of positioning/through holes 431 are formed in the carrier 43 and extend therethrough along a front-to-back direction. The platform 45 and the bars 44 define a pair of passageways/openings/recesses 46 therebetween. A mounting slot 451 is formed in a top surface of the platform 45. A pair of clapboards 441 extend upwardly and inwardly from the corresponding bars 44.

A metal/grounding plate 30 is assembled to the platform 45 with a planar plate 31 received within the mounting slot 451 and a tap 32 extending forwardly therefrom to connect with the ground contact 222. The metal plate 30 is T-shaped plate. The lateral ends of the planar plate 31 are placed below the corresponding clapboards 441 to upwardly abut against the corresponding clapboards 441.

The cable 200 includes a plurality of coaxial wires 201, a plurality of conductive wires 202, and an insulative sheath 203 receiving therein. The conductive wires 202 are unshielded twisted pair (UTP). Each coaxial wire 201 includes a conductor 2011, an insulative layer 2012 enclosing the conductor 2011, and a woven/braiding/shielding/grounding layer 2013 enclosing the insulative layer 2012. Notably, the coaxial wires 201 are inserted through the corresponding positioning holes 431 and across the corresponding passageways 46, that the outer layers of the coaxial wires 201 could be removed therefrom along both of a top-to-bottom direction and a bottom-to-top direction by a cut process to expose the conductor 2011 and the woven layer 2013.

The second connecting portions 221 of the second contacts 22 are received within the corresponding upward grooves 121 to connect with the corresponding conductors 2011 of the coaxial wires 201. The first connecting portions 211 of the first contacts 21 are received within the corresponding downward grooves 122 of the insulative housing 10 to connect with the corresponding conductive wires 202. The woven layers 2013 are exposed on the metal plate 30 and are soldered to the planar plate 31. Understandably, the clapboards 441 could block the welding liquid from flowing outwardly when the woven layers 2013 being soldered to the metal plate 30.

A metallic shell 60 has a front shell 61 and a rear shell 62 cooperated to enclose the insulative housing 10, the contacts 20, the metal plate 30, the spacer 40, and a front portion of the cable 200 therein. The front shell 61 and the rear shell 62 are assembled together through an engaging means.

The cable connector assembly 1 could be a USB 3.1 Standard-A to USB Type C cable connector assembly. The connector 100 could be a USB 3.1 Standard-A type connector. The other side of the cable 200 could be connected with a USB Type C connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a cable including a plurality of coaxial wires and a plurality of unshielded wires; and a connector including an insulative housing with a front tongue and a rear end, a plurality of contacts with mating portions exposed on the front tongue and connecting portions exposed on the rear end, and a spacer assembled to the rear end;

wherein the spacer forms a plurality of positioning holes extending therethrough along a front-to-back direction, and a passageway extending therethrough along a vertical direction perpendicular to the front-to-back direction;

wherein the coaxial wires are inserted through corresponding positioning holes and across the passageway to reach corresponding contacts along the front-to-back direction and the coaxial wires are cut in the passageway along the vertical direction;

wherein the spacer includes a base, a pair of bars extending forwardly from lateral sides of the base, and a platform extending forwardly from a front middle portion of the base, wherein the metal plate is mounted on the platform and the passageway is defined between the platform and the bars.

2. The cable connector assembly as claimed in claim 1, further comprising a metal plate retained on the spacer, the contacts including a ground contact connected with the metal plate, each of the coaxial wires including a conductor, an insulative layer enclosing the conductor, and a woven layer enclosing the insulative layer, wherein the woven layers are soldered to the metal plate.

3. The cable connector assembly as claimed in claim 2, wherein each of the bars forms a clapboard extending upwardly and inwardly therefrom to block welding liquid from flowing outwardly during soldering the woven layers to the metal plate.

4. The cable connector assembly as recited in claim 3, wherein the metal plate has a planar plate mounted to the platform and a tap extending forwardly from the planar plate to connect with the ground contact.

5. The cable connector assembly as recited in claim 4, wherein the two lateral sides of the planar plate are located below corresponding clapboards.

6. The cable connector assembly as recited in claim 4, wherein the contacts include a row of first contacts with the connecting portions connected to corresponding unshielded wires and a row of second contacts with the connecting portions connected to corresponding coaxial wires.

7. The cable connector assembly as recited in claim 6, wherein the contact portions of the first contacts, the contact portions of the second contacts, and the connecting portions of the second contacts are disposed on a top surface of the insulative housing.

8. The cable connector assembly as recited in claim 6, wherein the connecting portions of the first contacts are disposed on a bottom surface of the insulative housing.

9. The cable connector assembly as recited in claim 6, wherein the mating portions of the first contacts are located in front of the mating portions of the second contacts, the mating portion of the first contact has a planar plate contour embedded in the tongue and exposed upwardly to exterior, and the mating portion of the second contact has a curved resilient structure.

10. The cable connector assembly as recited in claim 6, wherein the first contacts and the unshielded wires are adapted to transmit low speed signals, and the second contacts and the coaxial wires are adapted to transmit high speed signals.

11. The cable connector assembly as recited in claim 6, further comprising an insulator retaining the second contacts, wherein the insulator is assembled and retained to the insulative housing.

12. A cable connector assembly comprising:

an insulative housing defining a mating tongue with thereon a mating surface facing toward an exterior in a vertical direction;

a plurality of first contacts disposed within the housing, each of said first contacts including, along a front-to-back direction perpendicular to said vertical direction, a front stationary contacting section exposed upon the mating surface, and a rear connecting section exposed around a rear end of the housing;

a plurality of second contacts disposed within the housing, each of said second contacts including a front deflectable contacting section exposed upon the mating surface, and a rear tail section exposed around the rear end of the housing;

an insulative spacer assembled to the rear end of the housing and forming a plurality of through holes extending along said front-to-back direction;

a metallic grounding plate associated with said spacer and spanning in a transverse direction perpendicular to both said vertical direction and said front-to-back direction, said grounding plate mechanically and electrically connecting to the rear tail section of a grounding contact of said second contacts; and a plurality of coaxial wires extending through the corresponding through holes, respectively, each of said coaxial wires including an exposed inner conductor secured upon the rear tail section of the corresponding second contact, and an exposed outer metallic braiding layer secured upon the grounding plate;

wherein said spacer forms a recess in front of the corresponding through holes for easy exposure of the outer metallic braiding layer of the corresponding wires extending through the corresponding through holes;

wherein the spacer includes a base, a pair of bars extending forwardly from lateral sides of the base, and a platform extending forwardly from a front middle portion of the base, wherein the metallic grounding plate is mounted on the platform and the recess is defined between the platform and the bars.

13. The cable connector assembly as claimed in claim 12, wherein the grounding plate is horizontally confined by said spacer.

14. The cable connector assembly as claimed in claim 12, wherein spacer forms a pair of clapboards on two lateral sides to prevent wicking on the grounding plate from escaping.

15. The cable connector assembly as claimed in claim 12, wherein said recess extends through the spacer in the vertical direction.

16. A cable connector assemble comprising:

an insulative housing defining a mating tongue with thereon a mating surface in a vertical direction;

a plurality of contacts disposed in the housing, each of said contacts including a front mating section exposed upon the mating surface and a rear connecting section exposed around a rear section of the housing;

an insulative spacer assembled to the rear section of the housing and forming a plurality of through holes along a front-to-back direction perpendicular to said vertical direction;

a metallic grounding plate associated with the spacer in front of said through hole in said front-to-back direction; and a plurality of coaxial wires extending through the corresponding through holes, respectively, each of said wires including an exposed inner conductor secured to the rear connecting section of the corresponding contact, and an exposed outer metallic braiding layer secured to the grounding plate;

wherein said spacer further includes a recess in front of said through holes for easy exposure of the outer metallic braiding layer;

wherein the spacer includes a base, a pair of bars extending forwardly from lateral sides of the base, and a platform extending forwardly from a front middle portion of the base, wherein the metallic grounding plate is mounted on the platform and the recess is defined between the platform and the bars.

17. The cable connector assemble as claimed in claim 16, wherein said grounding plate is mechanically and electrically connected to the rear connecting section of a grounding contact of said contacts.

* * * * *